US005094141A

United States Patent [19]

Zwingel et al.

[11] Patent Number: 5,094,141

[45] Date of Patent: Mar. 10, 1992

[54] ARRANGEMENT FOR ACCELERATING A PROJECTILE THROUGH A PLASMA

[75] Inventors: Dieter Zwingel; Klaus Zocha, both of Simmelsdorf; Markus Löffler, Unterluss, all of Fed. Rep. of Germany

[73] Assignees: Diehl GmbH & Co., Nürnberg; Rheinmetall GmbH, Düsseldorf, both of Fed. Rep. of Germany

[21] Appl. No.: 750,767

[22] Filed: Aug. 22, 1991

Related U.S. Application Data

[63] Continuation of Ser. No. 498,996, Mar. 26, 1990, abandoned.

[30] Foreign Application Priority Data

Apr. 1, 1989 [DE] Fed. Rep. of Germany ..... 3910566

[51] Int. Cl.[5] ..... F41B 6/00

[52] U.S. Cl. ..... 89/8; 102/522; 124/3

[58] Field of Search ..... 89/8; 102/202.9, 522; 124/3; 376/101

[56] References Cited

U.S. PATENT DOCUMENTS

| | | | |
|---|---|---|---|
| 667,435 | 2/1901 | Friese-Greene et al. | 89/8 |
| 3,148,472 | 9/1964 | Hegge et al. | 102/521 |
| 3,251,216 | 5/1966 | Broske | 102/202.9 |
| 3,563,177 | 2/1971 | Ritchey | 102/431 |
| 4,040,359 | 8/1977 | Blajda et al. | 102/527 |
| 4,867,067 | 9/1989 | Becker et al. | 102/521 |
| 4,913,029 | 4/1990 | Tidman et al. | 89/8 |
| 5,042,359 | 8/1991 | Witt et al. | 89/8 |

FOREIGN PATENT DOCUMENTS

| | | | |
|---|---|---|---|
| 0152492 | 8/1985 | European Pat. Off. . | |
| 0190548 | 8/1986 | European Pat. Off. . | |
| 242501 | 10/1987 | European Pat. Off. | 89/8 |
| 3613260 | 10/1987 | Fed. Rep. of Germany . | |
| 310299 | 12/1989 | Japan | 124/3 |
| 2207985 | 2/1989 | United Kingdom . | |

*Primary Examiner*—Stephen C. Bentley

*Attorney, Agent, or Firm*—Scully, Scott, Murphy & Presser

[57] ABSTRACT

An arrangement for the accelerating of a projectile through the intermediary of a plasma, wherein the plasma is generated by means of an electrical discharging circuit within a metallic tube which has the bottom thereof closed. The one pole of the discharging circuit contacts a first electrode which is formed on the tube rearwardly of the projectile, and in the other pole of the discharging circuit is connected with the casing or jacket of the tube. The projectile, which constitutes the second electrode, forms a current collector which contacts in the casing or jacket of the tube and slides therein during the acceleration of the projectile. The current collector hereby acts in the manner of a sliding contact which, during the acceleration of the projectile, remains in electrical contact with the tube.

11 Claims, 1 Drawing Sheet

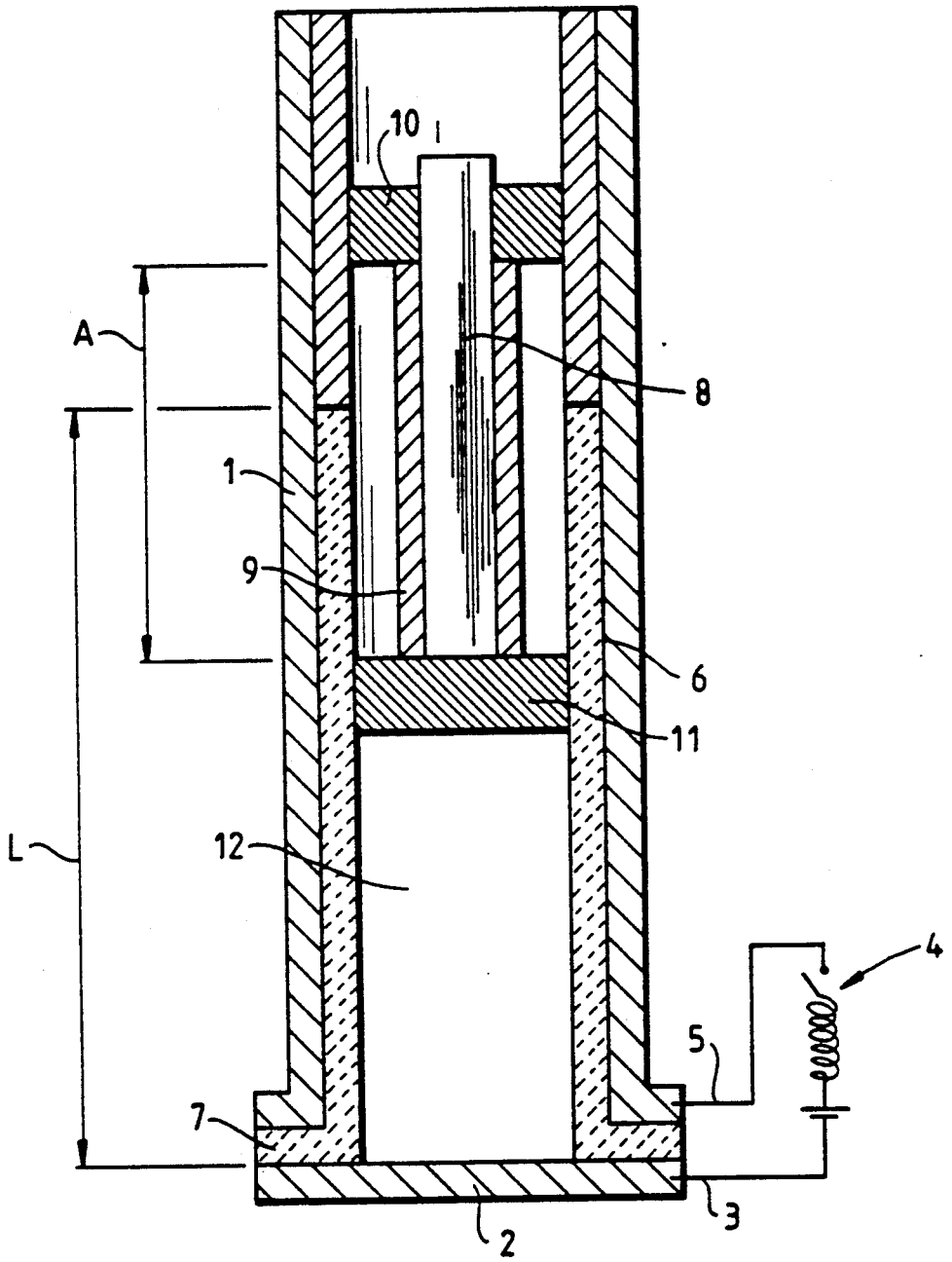
10
A
8
1
9
6
11
L
12
4
5
7
3
2

ARRANGEMENT FOR ACCELERATING A PROJECTILE THROUGH A PLASMA

This application is a continuation of application Ser. No. 498,996, filed on Mar. 26, 1990, now abandoned.

BACKGROUND OF THE INVENTION

1. Field of the Invention

The present invention relates to an arrangement for the accelerating of a projectile through the intermediary of a plasma, wherein the plasma is generated by means of an electrical discharging circuit within a metallic tube which has the bottom thereof closed, in which the one pole of the discharging circuit contacts a first electrode which is formed on the tube rearwardly of the projectile, and in which the other pole of the discharging circuit is connected with the casing or jacket of the tube.

2. Discussion of the Prior Art

An arrangement of the type considered herein is described in the disclosure of German Laid-Open Patent Appln. 36 13 260. The first electrode is formed by the bottom of the tube. The second electrode is formed from the jacket or casing of the tube. Upon the activation of the discharging circuit, an electric arc is generated between the bottom of the tube and the jacket of the tube. As a consequence of the foregoing, there is produced a plasma which accelerates the projectile within the tube.

Pursuant to the disclosure of the above-mentioned German OS 36 13 260, the development of the electric arc, and as a consequence also the progress in the pressure rise over a period of time is not determined by the position of the projectile within the tube.

SUMMARY OF THE INVENTION

Accordingly, it is an object of the present invention to provide an arrangement of the above-mentioned type in which, for effectuating an improvement over the course of the pressure during the development of the plasma, there is achieved a simple current supply to the projectile.

Inventively, the above-mentioned object is achieved through the intermediary of an arrangement of the above-described type, in that the projectile, which constitutes the second electrode, forms a current collector which contacts in the casing or jacket of the tube and slides therein during the acceleration of the projectile.

The current collector acts in the manner of a sliding contact which, during the acceleration of the projectile, remains in electrical contact with the tube. The formation of the electric arc is effected intermediate the electrode which is formed by the projectile and the electrode which is formed on the tube. As a result thereof, during the movement of the projectile, the electric arc is drawn along therewith. Consequently, the electric arc is thus lengthened. This leads to an improvement in the course or progress of the pressure and, thereby, to an increase in the power output.

In a preferred embodiment of the invention, a base of the projectile forms the second electrode which is distanced from the current collector along the longitudinal direction of the projectile. Preferably, in the starting position for the projectile, the current collector is hereby located in the metallic jacket of the tube in front of a sleeve-like insulator which extends to the bottom of the tube. As a consequence, achieved thereby is that the electric arc will only form itself between the base of the projectile and the bottom of the tube, as long as the second electrode moves along the insulator. Through the configuring of the length of the insulator it is accordingly possible to determine the formation of the electric arc and thereby the course of the pressure.

BRIEF DESCRIPTION OF THE DRAWING

Further advantageous embodiments of the invention can now be more readily ascertained from the following detailed description of an exemplary embodiment thereof, taken in conjunction with the accompanying single figure of drawing illustrating an arrangement for the acceleration of the projectile, as shown in a diagrammatic and longitudinal cross-sectional representation.

DETAILED DESCRIPTION

A metallic tube or conduit 1 possesses a tube bottom 2 to which there is connected a first pole 3 of a discharging circuit 4. A second pole 5 of the discharging circuit 4 is connected with the metallic tube 1.

Arranged within a tube 1 is a sleeve-like insulator 6 which, for example, may be constituted of ceramic material. This insulator extends from the tube bottom 2 along the longitudinal direction of the tube 1 up to a length L. Through the provision of a flange or shoulder 7 on the insulator 6, there is produced an electrical insulation between the tube bottom 2 and the tube 1. The insulator 6 and the tube 1 are both of the same caliber.

A projectile which is provided for the tube 1 is constituted from a missile 8 arranged in a propulsion mechanism 9 which possesses a front portion 10 and a rear portion 11. The portions 10, 11 are electrically conductive and are electrically-conductively interconnected with each other. The front portion 10 forms a current collector which electrically contacts the interior of the tube 1. The rear portion 11 forms the second electrode of the arrangement. The front portion 10 is located a distance A from the rear portion 11. The distance A and the length L are correlated in such a manner with respect to each other that, when the projectile stands in the initial or starting position thereof, the current collector 10 will no longer contact against the insulator 6 but will already contact the metallic tube 1. In the figure of the drawing, the missile 8 and the propulsion mechanism 9 are illustrated in the position shortly subsequent to the firing thereof.

The manner in the functioning of the above-described arrangement is generally as follows:

Already preceding the firing does the current collector 10 contact against the metallic tube 1. During the discharge of the discharging circuit 4 there is formed an electric arc between the tube bottom 2 and the rear portion 11 of the propulsion mechanism 9. As a result thereof, there is produced a plasma in the pressure chamber 12, which accelerates the propulsion mechanism 9 in conjunction with the missile 8. During the movement of the propulsion mechanism 9, the current collector 10 continues to remain in electrical contact with the tube 1. The electric arc which is present between the tube bottom 2 and the rear portion 11 is extended in the length thereof. Because of the presence of the insulator 6, an electric arc is not generated between the tube 1 and the tube bottom 2.

When the rear portion 11 of the propulsion mechanism 9 egresses from the insulator 6, then at the latest instant will the electric arc tear apart between the tube bottom 2 and the rear portion 11.

What is claimed is:

1. An arrangement for the accelerating of a projectile through the intermediary of a plasma generated by an electrical discharging circuit in a metallic tube having a closed metallic bottom, an insulating sleeve being arranged within said metallic tube so as to electrically insulate said tube from the metallic bottom, said projectile being arranged in said tube, one pole of said discharging circuit electrically contacting a first electrode which is formed by said metallic bottom rearwardly of said projectile, and the other pole of the discharging circuit is connected with the jacket of said tube, said projectile having a rear portion constituting a second electrode located within the axial extent of said insulating sleeve and a leading portion forming a current collector contacting the interior surface of the metallic tube so as to be slidable in electrical contact therewith during acceleration of the projectile, whereby an electric arc is produced intermediate said first and second electrodes generating a plasma for accelerating said projectile, said continual contact between the current collector and said metallic tube during forward acceleration of said projectile maintaining and extending said electric arc until said rear portion of the projectile exits from said insulating sleeve so as to regulate the pressure acting on the projectile by the generated plasma.

2. An arrangement as claimed in claim 1, wherein, in the starting position of the projectile and during acceleration thereof, the current collector continually electrically contacts the metallic tube upstream of said insulating sleeve which extends to the bottom of the tube.

3. An arrangement as claimed in claim 1, wherein the length of the electrical insulating sleeve within the lower portion of the metallic tube and the distance of the rear portion of the projectile constituting said second-electrode from the current collector are correlated with respect to each other so as to generate an electrical arc between the tube bottom and the base of the projectile which increases in length during the acceleration of the projectile within said insulating sleeve.

4. An arrangement as claimed in claim 2, wherein the insulator and the tube possess the same size of caliber.

5. An arrangement as claimed in claim 1, wherein the projectile comprises a missile with a propulsion mechanism which forms the current collector.

6. An arrangement as claimed in claim 5, wherein the propulsion mechanism includes a front portion forming the current collector and a rear portion spaced from in the front portion in the longitudinal direction and forming the second electrode.

7. A method for accelerating of a projectile through the intermediary of a plasma generated by an electrical discharging circuit in a metallic tube having a closed metallic bottom, an insulating sleeve being arranged within said metallic tube so as to electrically insulate said tube from the metallic bottom, comprising arranging said projectile in said tube such that one pole of said discharging circuit electrically contacts a first electrode which is formed by said metallic bottom rearwardly of said projectile; connecting another pole of the discharging circuit to the said metallic tube, said projectile having a rear portion constituting a second electrode located within the axial confines of said insulating sleeve and a leading portion forming a current collector contacting the interior surface of the metallic tube so as to be slidable in continuous electrical contact therewith during acceleration of the projectile; producing an electric arc intermediate said first and second electrodes to generate a plasma for accelerating said projectile; and maintaining said continual contact between the current collector and said metallic tube during forward acceleration of said projectile to thereby extend said electric arc until said rear portion of the projectile exits from said insulating sleeve to regulate the pressure acting on the projectile by the generated plasma.

8. A method as claimed in claim 7, wherein a base of said projectile is formed by said second electrode which is spaced from the current collector along the longitudinal direction of the projectile.

9. A method as claimed in claim 7, wherein, in the starting position and during acceleration of the projectile, the current collector continually contacts the surface of the metallic tube upstream of said insulating sleeve which extends to the bottom of the tube.

10. A method as claimed in claim 9, wherein said first electrode is located on the tube bottom, said insulating sleeve contacting the tube bottom and electrically insulating the tube bottom from the metallic tube.

11. A method as claim in claim 9, wherein the length of the electrical insulating sleeve and the distance between the base of the projectile and the current collector at the leading end thereof are correlated with respect to each other so as to generate an electrical are between the tube bottom and the base of the projectile which increases in length during the acceleration of the projectile.

* * * * *